US008091491B2

(12) United States Patent
Magaldi et al.

(10) Patent No.: US 8,091,491 B2
(45) Date of Patent: Jan. 10, 2012

(54) INTEGRATED SYSTEM FOR THE EXTRACTION OF HEAVY ASH, CONVERSION THEREOF INTO LIGHT ASH AND REDUCTION OF UNBURNT MATTER

(75) Inventors: Mario Magaldi, Salerno (IT); Rocco Sorrenti, Salerno (IT)

(73) Assignee: Magaldi Power S.p.A., Salerno (IT)

( * ) Notice: Subject to any disclaimer, the term of this patent is extended or adjusted under 35 U.S.C. 154(b) by 598 days.

(21) Appl. No.: 11/631,995

(22) PCT Filed: Jul. 8, 2005

(86) PCT No.: PCT/EP2005/007536

§ 371 (c)(1),
(2), (4) Date: Jan. 10, 2008

(87) PCT Pub. No.: WO2006/005574

PCT Pub. Date: Jan. 19, 2006

(65) Prior Publication Data

US 2008/0229985 A1 Sep. 25, 2008

(30) Foreign Application Priority Data

Jul. 9, 2004 (IT) ..... MI2004A1371

(51) Int. Cl.

| | |
|---|---|
| ***F23K 3/02*** | (2006.01) |
| ***F23K 1/00*** | (2006.01) |
| ***F23J 1/00*** | (2006.01) |
| ***F23J 3/00*** | (2006.01) |

(52) U.S. Cl. ..... 110/165 A; 110/232; 110/106; 110/216; 110/347

(58) Field of Classification Search ..... 110/344, 110/106, 165 R, 165 A, 216, 232, 259, 261, 110/263, 266, 347

See application file for complete search history.

(56) References Cited

U.S. PATENT DOCUMENTS

| | | | | |
|---|---|---|---|---|
| 2,040,416 | A * | 5/1936 | Upson | 110/220 |
| 2,750,903 | A * | 6/1956 | Miller et al. | 110/165 A |
| 4,508,041 | A * | 4/1985 | Voetter et al. | 110/347 |
| 4,969,930 | A * | 11/1990 | Arpalahti | 110/347 |
| 5,161,471 | A * | 11/1992 | Piekos | 110/165 R |
| 5,992,336 | A * | 11/1999 | Ramme | 110/344 |
| 6,038,987 | A * | 3/2000 | Koshinski | 110/344 |
| 6,418,866 | B1 * | 7/2002 | Shimizu et al. | 110/347 |
| 6,637,354 | B2 * | 10/2003 | Ramme | 110/342 |

FOREIGN PATENT DOCUMENTS

| | | |
|---|---|---|
| EP | 0471055 | 7/1995 |
| JP | 61-23006 | 2/1986 |
| JP | 61-23007 | 2/1986 |
| JP | 01111107 | 7/1989 |
| WO | WO 97/45675 | 12/1997 |

* cited by examiner

*Primary Examiner* — Kenneth Rinehart

*Assistant Examiner* — David J Laux

(74) *Attorney, Agent, or Firm* — Olson & Cepuritis, Ltd.

(57) ABSTRACT

The present invention is about a process for treating all the ashes produced by a coal dust boiler (1), able to reduce the total unburnt matter content, to increase the combustion efficiency of the boiler (1), and to have the light ashes as the only waste arising from the coal combustion. In particular, said process provides for the extraction of the heavy ashes (4) from the boiler bottom (23), the ashes coming from the hoppers of the economizers (5) and the fraction of light ash richer of unburnt matter coming from the filters (11) used to collect the dust from the flue gas; said ashes are mixed in a silo (15), proportioned and transferred in one or more feeders (17) of the coal mills (18), and reintroduced in the boiler (1) after being mixed with the coal through the burners (2).

7 Claims, 4 Drawing Sheets

LEGEND

A = Ash
C = Coal
EA = Economizer Ash
F = Fines
FG = Flue Gas
HA = Heavy Ash
LA = Light Ash
PA = Pulverized Ash
PC = Pulverized Coal

LEGEND

A = Ash
C = Coal
EA = Economizer Ash
F = Fines
FG = Flue Gas
HA = Heavy Ash
LA = Light Ash
PA = Pulverized Ash
PC = Pulverized Coal

LEGEND

A = Ash

C = Coal

EA = Economizer Ash

F = Fines

FG = Flue Gas

HA = Heavy Ash

LA = Light Ash

PA = Pulverized Ash

PC = Pulverized Coal

PC + PA

LEGEND

A = Ash

C = Coal

EA = Economizer Ash

F = Fines

FG = Flue Gas

HA = Heavy Ash

LA = Light Ash

PA = Pulverized Ash

PC = Pulverized Coal

PC + PA

INTEGRATED SYSTEM FOR THE EXTRACTION OF HEAVY ASH, CONVERSION THEREOF INTO LIGHT ASH AND REDUCTION OF UNBURNT MATTER

The thermoelectric power plants using coal as a fuel have often the problem to discharge the ashes obtained as a coal combustion by-product. The possibility to use the volatile ashes as a concrete additive often allows to transform the discharge costs into an economic benefit, on condition to comply with the severe quality rules imposed by concrete manufacturers. The most important parameters which restrict the ash reuse in concrete manufacture are the unburnt matter percentage, which has to be lower than 5%, and the granulometry. In the steam production boilers provided with the new combustion systems for obtaining the nitrogen oxides ($NO_x$) reduction it is more and more difficult to limit the unburnt matter percentage in the ash produced by the coal combustion, either for the heavy or the light ash.

At present, in the plant engineering field, the volatile and heavy ashes, and the ashes coming from the economizer hoppers, are handled by independent conveyance and stockage assemblies, with consequent useless increases of investment and management costs. Furthermore, the light ashes collected in the hoppers of the last electrofilter sections, although not being so much in mass percentage, have a considerable unburnt matter content (20%÷30%) which contributes to increase the unburnt matter average quantity of all the light ashes.

Concerning the heavy ashes extraction, with reference to the European Patent No. 0 471 055 B1, the traditional system for the heavy ashes dry extraction provides for the ash to be extracted from the bottom of the boiler and then cooled, ground and subsequently sent to the dedicated stockage silos or mixed with the light ashes. In the cited traditional system, to obtain a heavy ash size compatible with the light ones, dedicated grinding mills are used. However, this operation involves a considerable wear of the grinding mechanisms and a considerable energy consumption, and furthermore the final product characteristics are similar but not identical to that of the light ashes, due to the difficulty to obtain a sufficiently fine size.

To recover the energy from the unburnt matter, particularly rich in heavy ashes, a further improvement has been obtained in a lignite power plant, where the dry extracted heavy ash only, after being cooled and ground, is mechanically conveyed to the fuel storage silos upon humidification. The problem related to this application is in the fact that the lignite mills, of hammer type, provides for a rather coarse size of the exiting ash particles with the consequence that, when the heavy ashes are conveyed to the boiler, a small percentage only of said ashes has a sufficient fine size in order to be conveyed by the flue gas together with the light ashes. This involves an increase of the flow rate of the heavy ashes extracted from the boiler bottom, but without influence on the unburnt matter content of the light ashes.

Therefore, the present invention has the double purpose to reduce the content of unburnt matter in the light ashes and to convert the heavy ashes of the economizers into light ashes, sending all these ashes, together with the fraction of volatile ash richer of unburnt matter, to the coal mills and from there to the boiler through the fuel burners.

The light ashes collected in the last hoppers of the electrofilters 11, in the hoppers of the air-flue gas exchanger 10, in the hoppers of the economizers 5 and the heavy ashes 4 are conveyed by a single pneumatic transportation assembly 19 to a cyclone 15, the conveying air, together with the fraction of thinner ash, is sent to the boiler 1 preferably in the hottest area above the burners, while the heavier fraction, proportioned and mixed with the fuel in the coal feeders, is ground by the coal mills and injected in the boiler through the burners.

All the ashes, when sent to the boiler together with the coal dust, undergo a heating process at temperatures of 1500÷1600° C. At these temperatures, the combustion processes are activated, considerably reducing the final content of unburnt matter. Furthermore, the so powdered ash, having a very fine granulometric distribution, is such to be conveyed by the combustion flue gas, with a minimum increase of the standard flow rate of the heavy ash to be extracted from the boiler bottom. Thus, with the present invention, in case of installation on existing dry extraction plants, it is not required to adjust the flow rate of the existing machines.

The innovative characteristics, objects and advantages of the present invention will be better highlighted in the following description and in the annexed drawings, illustrating embodiments given in a not limiting way, in which.

It should be pointed out that the same reference numbers in the different Figures indicate the same or equivalent parts.

Figure 1:
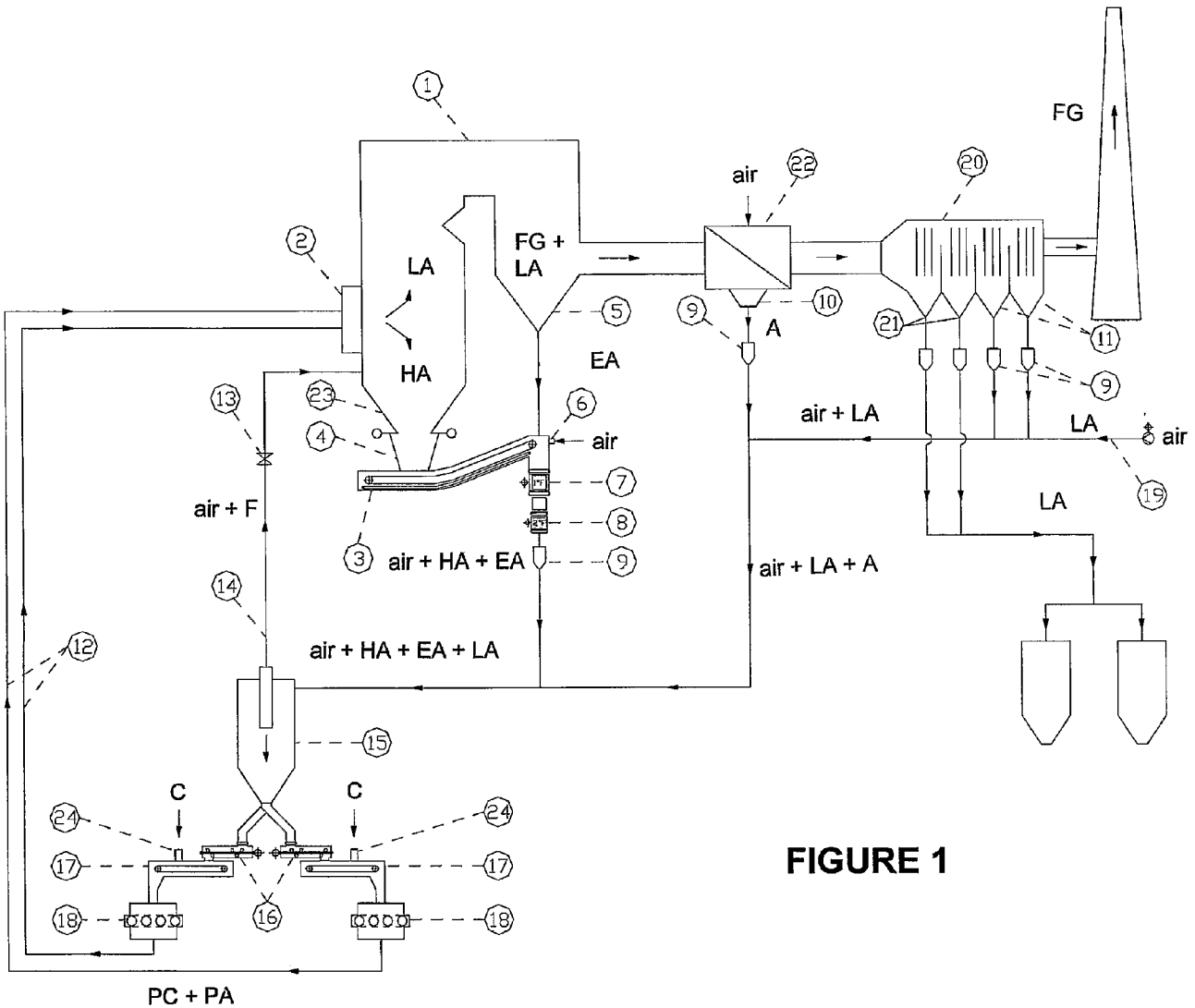
FIG. 1 shows the general operation diagram, in which all the ashes are returned to the boiler.

The present invention is related to a dry extraction and conveyance system of all the ashes produced in a coal dust boiler 1, and to the recirculation of said ashes in the boiler.

The light ashes collected by the hoppers of the last section 11, or the last two sections 11, of the electrofilter 20 are pneumatically conveyed to a separator cyclone 15. In the cyclone 15, the ashes with heavier fraction precipitate toward the bottom, while the lighter fractions are sucked from the top of the cyclone through a tube 14 directly connected to the boiler 1, which is under vacuum. A check valve 13 is placed on the tube which connects the boiler 1 to the cyclone 15, said valve allowing the conveying air to be sucked from the boiler 1 and avoiding the hot flue gas of the combustion chamber to be returned to the cyclone 15 in case of a pressure increment in the combustion chamber. Said check valve 13 is required for safety reasons, since the ash present in the cyclone 15 has a considerable quantity of unburnt matter which could catch fire in presence of hot combustion gases.

Any ash collected by the hopper of the air exchanger 22 is transferred, by the same light ash pneumatic conveyor, to the same separator cyclone 15.

The ashes coming from the hoppers of the economizers 5 are discharged instead by gravity in the extractor 3 of the heavy ash system.

The heavy ashes are extracted from the boiler bottom 23 through an extraction system consisting of a hopper 4, which connects the boiler 1 to the closed metal conveyor 3 able to extract the heavy ash and to convey and cool it in countercurrent thanks to inlet holes for the air sucked by the boiler 1 vacuum, through proper openings obtained on the machine 6; downstream the extractor 3, the heavy ash undergo the size reduction in two subsequent grinding stages, thanks to a grinder 7 followed by another grinder or mill 8. The first grinding stage 7 serves for reducing the ash size to be transported with a vacuum or pressure pneumatic conveyor 19.

The pneumatic conveyor assembly 19 is the same for all the ash transportations. In this way, the heavy ash too is conveyed to the separation cyclone 15 as it happens for the other ashes.

Figure 3:
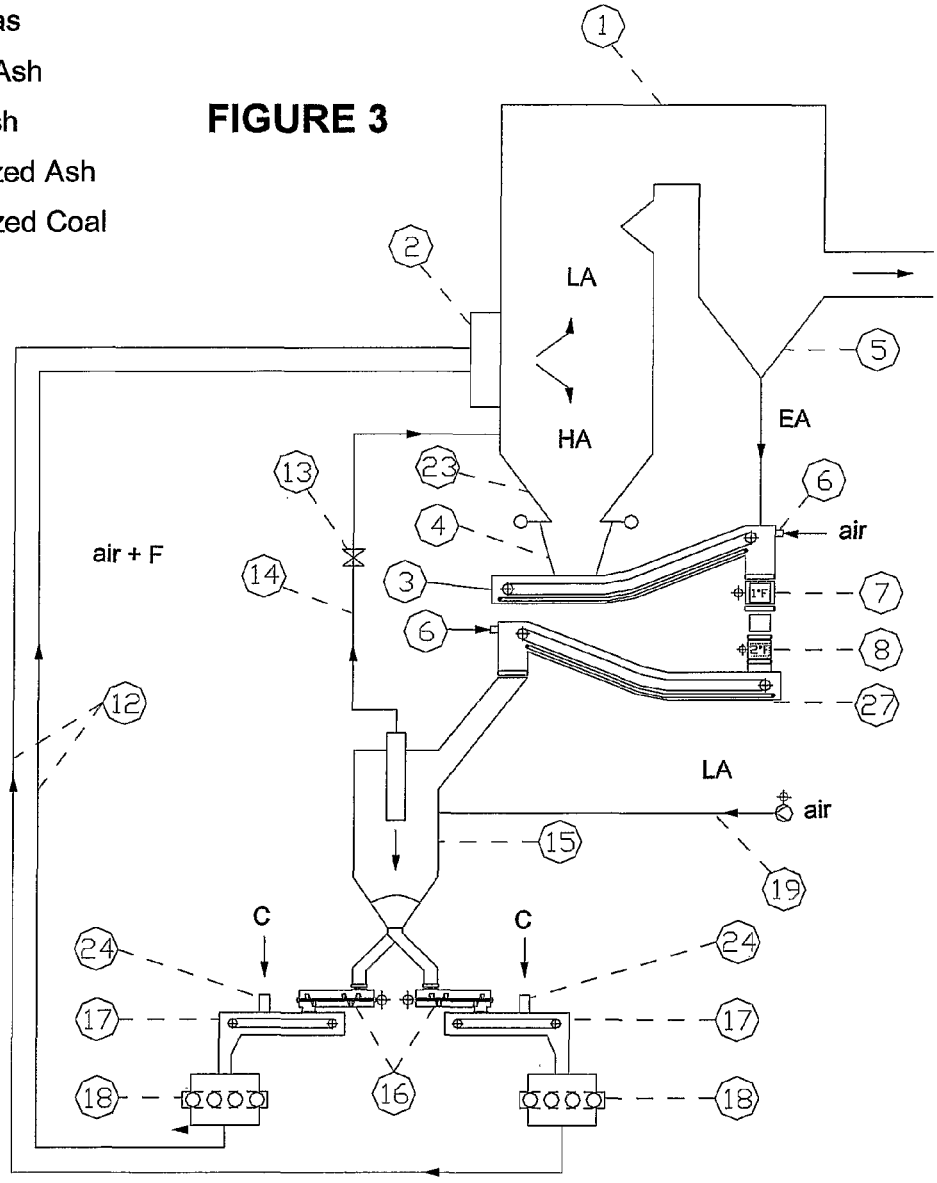
FIG. 3 is a schematic view in which the heavy ash and the ash coming from the economizers is mechanically conveyed to the separation silo.

The heavy ashes, if coarsely ground, can also be transported to the cyclone 15 by a mechanic conveyor 27, being mixed in said cyclone 15 with the light ashes delivered with the pneumatic means 19 (see FIG. 3).

The separation cyclone 15, as well as having the function of a separator between ash and air, has also the function of storage silo. Each cyclone can feed one or more proportioning devices 16, which serve to set the ash delivery as a function of the coal delivery entering the coal mills 18. In this way, the ash delivery is mixed with the coal 24 present in the feeder 17 of the mill 18, in order to always obtain a constant ratio.

The mixing with coal of all the treated ash, that is light ash 11, ash coming from the air heaters 10, ash coming from the economizers 5 and heavy ash 4, in the feeders 17, directly upstream the pulverizing mills 18, allows an optimal ash distribution in the fuel. In this way, it is sufficient a single feeding point for the ash to distribute it in the coal, without having to feed it in each single burner 2. In fact, it is known in the state of the art that each mill can feed several burners at the same time, typically three to five. Furthermore, this solution of feeding the ash directly in the coal feeder 17 assures a distribution of the thermal load quantity, due to the combustion of the coal contained in the ash, for each burner.

The total ash distribution to all the mill feeders allows to reduce as well the wear of the mill grinding elements, since the total ash delivery is split by the number of feeders 17.

The recirculation of the light ash in the mills 18 involves a slight wear increase of the mill 18 grinding elements, since the light ash, being already very fine, is rapidly transported by the mill's air in very short times. The coarsest percentage only of the light and heavy ashes undergo pulverization in the coal mills 18.

Figure 2:
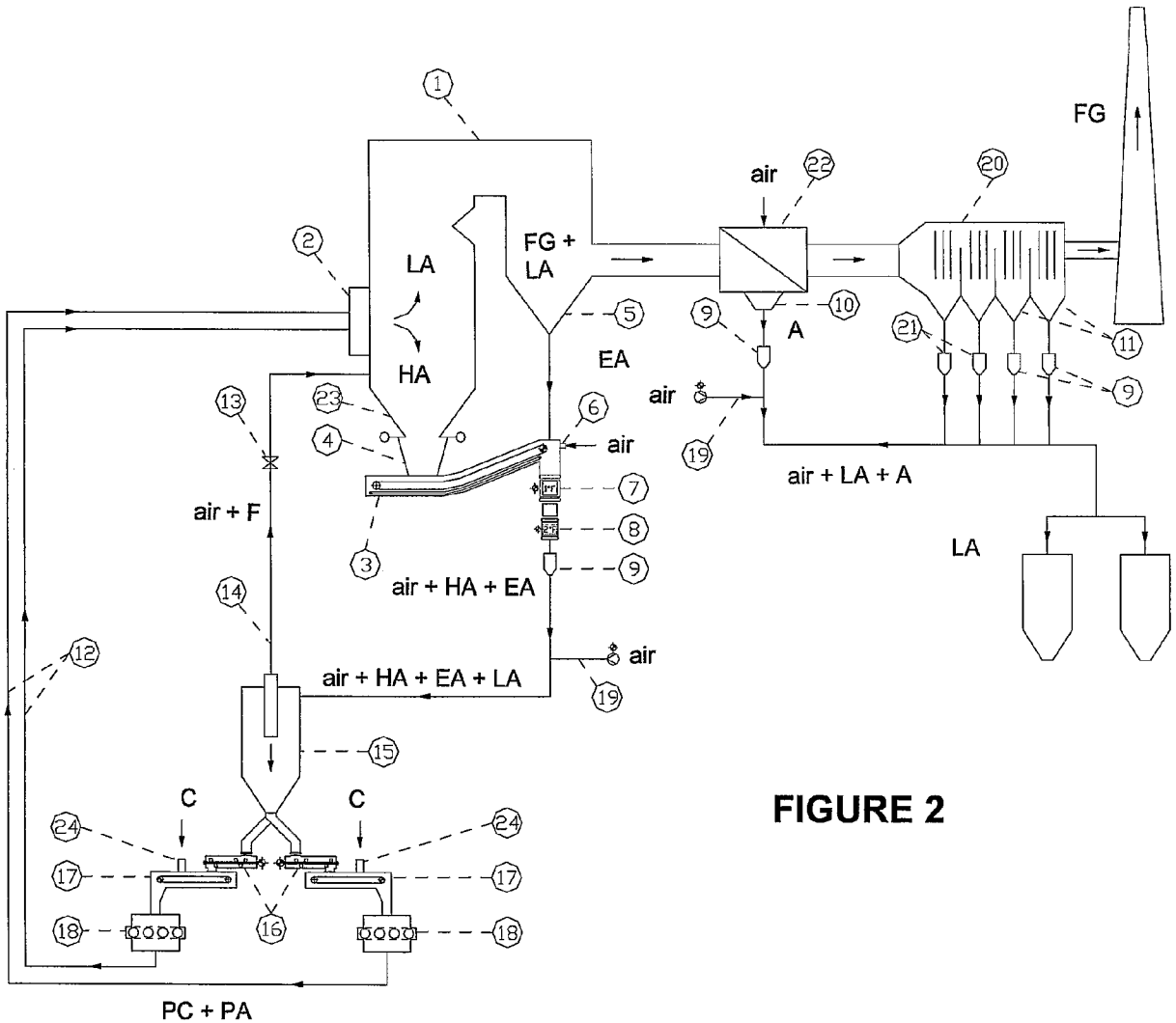
FIG. 2 is a schematic view in which the heavy ash only and the ash coming from the economizers are returned to the boiler.

In case the unburnt matter content of the light ashes is very low, and thus not being convenient the recirculation in the boiler, the plant configuration is that shown in FIG. 2. In this case, the recirculated ash is only that coming from the boiler bottom 23 and the economizers 5. All the ashes are pneumatically or mechanically transported to the ash separation and storage cyclone 15.

Figure 4:
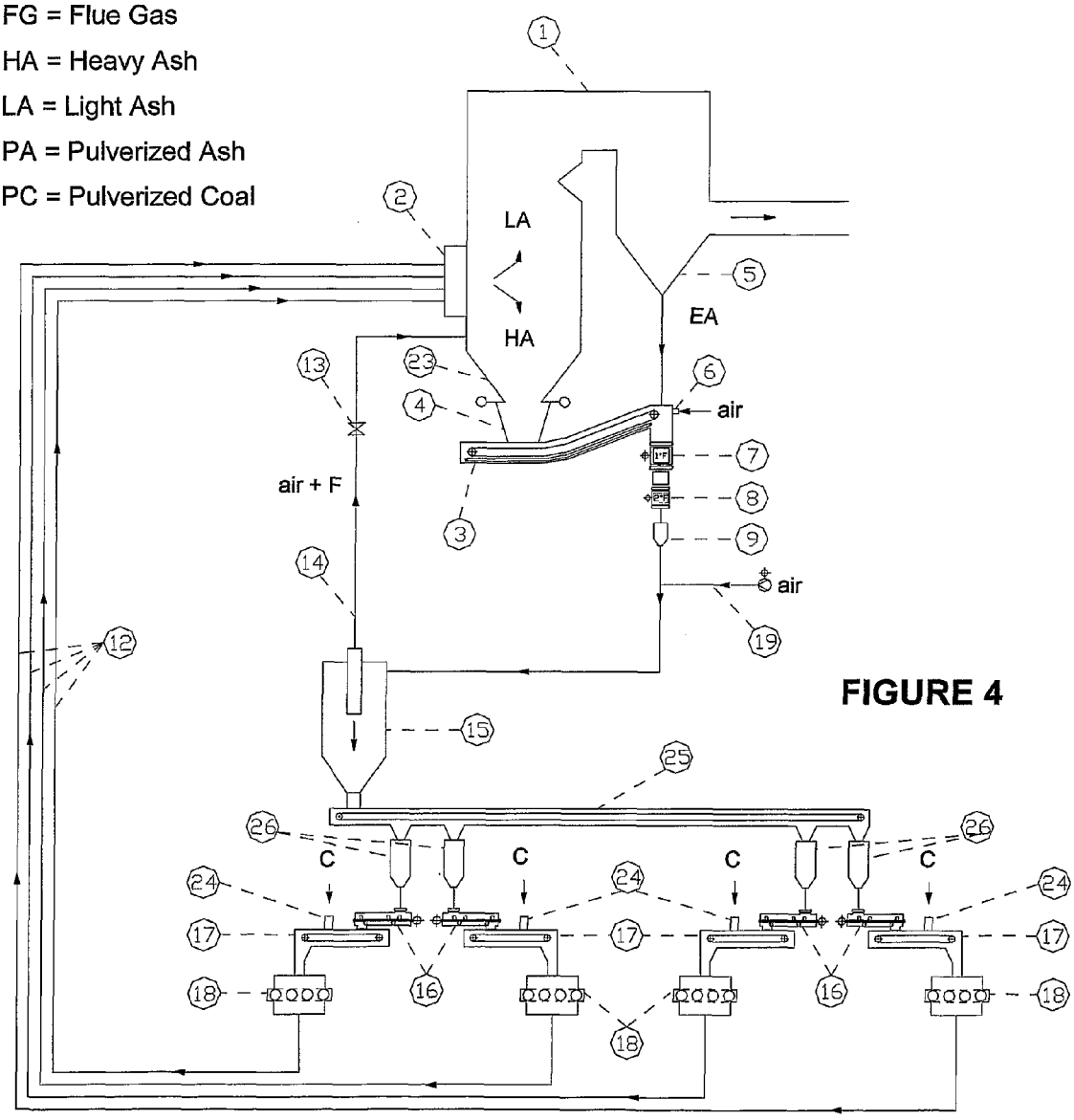
FIG. 4 is a schematic view in which the ash is mechanically conveyed to all the mills using a mechanic conveyor.

In FIG. 4, the extraction of the ash from the cyclone 15, connected to the boiler 1 through the aeration conduit 14, is performed with a scraper chain conveyor 25, and said ash is transported to storage silos 26, one for each feeder of the coal mill 18. For each storage silo 26 a proportioning device 16 is provided, to set the ash delivery. The ash weighed in this way by the proportioning device 16 is mixed with the coal in the mill 18 during the grinding process.

The invention claimed is:

1. A system for conversion of ashes produced by a steam production boiler fed by fossil fuel into light ashes which comprises:

a grinder for receiving the ashes from the steam production boiler and an associated economizer, and producing ground ashes;

a mechanical conveyor downstream from the grinder for receiving the ground ashes;

a separator cyclone downstream from the mechanical conveyor and adapted to receive the ground ashes from the mechanical conveyor;

a proportioning mixer downstream from the separator cyclone for combining the ground ashes with fossil fuel to produce ground ash and fossil fuel admixture;

a pulverizing mill downstream from the proportioning mixer for receiving the ground ash and fossil fuel admixture and producing a pulverized boiler feed; and a return conduit in communication with the pulverizing mill and the boiler for introduction of the pulverized boiler feed into the boiler.

2. An integrated process for the conversion of ashes produced by a steam production boiler (1) fed by fossil fuel into light ashes, with a lower unburnt matter content, comprising the steps of:

grinding heavy ash (4) and ash coming from economizers (5) in one or more grinders (7,8) to produce ground ashes before mixing with the fossil fuel;

sending all the ground ashes to a separator cyclone (15) through a single dry conveyance system (19);

mixing the ground ashes with said fossil fuel using one or more proportioning devices (16) to produce a ground ash and fossil fuel admixture;

grinding the produced admixture in one or more mills (18) dedicated to coal pulverization; and reintroducing all the ground ashes in said boiler (1) together with the fossil fuel.

3. The process according to claim 1, characterized in that the heavy ash (4) only and the ash coming from the economizers (5) are ground and undergo a recirculation in the boiler (1), after being ground in said one or more coal mills (18), in case the unburnt matter content in the light ashes is already low.

4. The process according to claim 2, characterized in that all ashes from boiler (1) and economizers (5) are converted into a single kind of ash by grinding and are collected in cyclone (15).

5. The process according to claim 2, characterized in that all ashes from boiler (1) and economizers (5) undergo a recirculation through a pneumatic conveyance (19) for mixing in said cyclone (15), from which a relatively lighter fraction is sent directly to the boiler (1), while the remaining fraction part is ground in the mills (18) after being mixed with the fuel.

6. The process according to claim 2, characterized in that only the coarsest ash fraction separated in the cyclone (15) is sent to the mills (18), with a consequent wear reduction and energy saving.

7. The process according to claim 2, characterized in that air used for the ash pneumatic conveyance to the cyclone (15) is directly sucked by the vacuum present in the combustion chamber.

* * * * *